US008245787B2

(12) United States Patent
White

(10) Patent No.: US 8,245,787 B2
(45) Date of Patent: Aug. 21, 2012

(54) UTILITY SKID TREE SUPPORT SYSTEM FOR SUBSEA WELLHEAD

(75) Inventor: Paul W. White, Aberdeenshire (GB)

(73) Assignee: Vetco Gray Inc., Houston, TX (US)

( * ) Notice: Subject to any disclaimer, the term of this patent is extended or adjusted under 35 U.S.C. 154(b) by 693 days.

(21) Appl. No.: 12/273,625

(22) Filed: Nov. 19, 2008

(65) Prior Publication Data

US 2009/0126938 A1 May 21, 2009

Related U.S. Application Data

(60) Provisional application No. 61/190,048, filed on Nov. 19, 2007.

(51) Int. Cl.
*E21B 7/12* (2006.01)

(52) U.S. Cl. ..... 166/368; 166/344

(58) Field of Classification Search ..... 166/338, 166/341, 344, 347, 378, 97.1, 75.13
See application file for complete search history.

(56) References Cited

U.S. PATENT DOCUMENTS 2,233,077 A * 2/1941 Gillespie et al. ..... 166/67
3,595,311 A * 7/1971 Harbonn et al. ..... 166/368
3,777,812 A 12/1973 Burkhardt et al.
4,095,649 A 6/1978 Chateau et al.
4,120,362 A 10/1978 Chateau et al.
4,190,120 A 2/1980 Regan
4,444,275 A 4/1984 Beynet et al.
4,572,298 A * 2/1986 Weston ..... 166/379
4,610,570 A * 9/1986 Brockway ..... 405/224
4,648,629 A * 3/1987 Baugh ..... 285/26
4,749,046 A 6/1988 Gano
4,848,475 A 7/1989 Dean et al.
5,255,745 A 10/1993 Czyrek
5,398,761 A * 3/1995 Reynolds et al. ..... 166/344
5,456,313 A * 10/1995 Hopper et al. ..... 166/97.1
5,492,436 A 2/1996 Suksumake
5,526,882 A 6/1996 Parks
5,992,526 A * 11/1999 Cunningham et al. ..... 166/343
6,209,650 B1 * 4/2001 Ingebrigtsen et al. ..... 166/368
6,481,504 B1 * 11/2002 Gatherar ..... 166/344
6,554,075 B2 4/2003 Fikes et al.
6,612,369 B1 * 9/2003 Rocha et al. ..... 166/363
6,637,514 B1 * 10/2003 Donald et al. ..... 166/368
6,675,900 B2 * 1/2004 Baskett et al. ..... 166/379
6,763,890 B2 7/2004 Polsky et al.
6,823,941 B2 * 11/2004 Donald ..... 166/368
6,902,005 B2 * 6/2005 Radi et al. ..... 166/345
6,907,932 B2 * 6/2005 Reimert ..... 166/341
6,966,383 B2 * 11/2005 Milberger et al. ..... 166/368
(Continued)

FOREIGN PATENT DOCUMENTS

EP 0952300 A1 3/1998
WO 2007075860 A3 7/2007

*Primary Examiner* — Thomas Beach
*Assistant Examiner* — Aaron Lembo
(74) *Attorney, Agent, or Firm* — Bracewell & Giuliani LLP

(57) ABSTRACT

A utility skid tree system for subsea wellheads enables a tree to be mounted by and interface with utility skids. Production bore access is provided through an extended production wing block. The system reacts and transfers installation loads and potential snag loads to the conductor. The tree accepts skids for flow boosting, metering, water-oil separation, etc. A conventional choke may be fitted outboard of the utility insert profile.

5 Claims, 5 Drawing Sheets

U.S. PATENT DOCUMENTS

| | | | | |
|---|---|---|---|---|
| 7,073,592 | B2 | 7/2006 | Polsky et al. | |
| 7,201,229 | B2 | 4/2007 | White et al. | |
| 7,243,729 | B2 * | 7/2007 | Tyrrell et al. | 166/338 |
| 7,596,996 | B2 * | 10/2009 | Zollo et al. | 73/152.29 |
| 7,757,772 | B2 * | 7/2010 | Donohue et al. | 166/344 |
| 2004/0026084 | A1 * | 2/2004 | Donald | 166/368 |
| 2005/0028984 | A1 * | 2/2005 | Donald et al. | 166/368 |
| 2007/0144743 | A1 | 6/2007 | White et al. | |
| 2008/0047714 | A1 | 2/2008 | McMiles | |
| 2008/0128139 | A1 * | 6/2008 | White | 166/368 |
| 2009/0025936 | A1 * | 1/2009 | Donald et al. | 166/344 |
| 2010/0300700 | A1 * | 12/2010 | Garbett et al. | 166/368 |

* cited by examiner 51
49
45
53
47
35
41
43
37
33
55
39
107
101
105
31
71
67
25
23
13
69
70
15
63
65
17
61
77
75
73
21
11
19

UTILITY SKID TREE SUPPORT SYSTEM FOR SUBSEA WELLHEAD

This non-provisional patent application claims priority to and the benefit of U.S. Provisional Patent Application No. 61/190,048, filed Nov. 19, 2007, and is incorporated herein by reference.

BACKGROUND OF THE INVENTION

1. Technical Field

The present invention relates in general to subsea wellheads and, in particular, to an improved system, method, and apparatus for a utility skid tree support system for subsea wellheads.

2. Description of the Related Art

In one type of offshore well production, a subsea production tree is installed at the sea floor. The tree may be connected by a flowline jumper to a subsea manifold, which may be connected to other subsea trees in the vicinity. A production riser may extend from the subsea manifold or from an individual tree to a processing facility, normally a floating platform. The well formation pressure is normally sufficient to cause the well fluid to flow up the well to the tree, and from the tree to the processing facility.

In very deep water, the well may have sufficient pressure to cause the well fluid to flow to the tree but not enough to flow from the sea floor to the processing facility. In other cases, the well may even lack sufficient pressure to flow well fluid to the sea floor. Downhole electrical submersible pumps have been used for many years in surface wells, but because of periodic required maintenance, are not normally employed downhole in a subsea well.

A variety of proposals have been made for well stimulation packages (e.g., booster pumps) to be installed at the sea floor to boost the well fluid pressure. However, because of the pump size, installation expense and technical difficulties, such installations are rare. When such configurations are used, large utility skids are typically used to move equipment to and from the subsea well from the surface. Utility skids are cumbersome and manipulating them with respect to the well can be very difficult if not hazardous to operators and the well installation itself. Thus, an improved system and method for facilitating interaction between subsea wells and utility skids would be desirable.

SUMMARY OF THE INVENTION

Embodiments of a system, method, and apparatus for a utility skid tree support system for subsea wellheads are disclosed. The invention enables a tree to be mounted by and precisely interface with utility skids. Production bore access is provided through an extended production wing block. The system reacts and transfers installation loads and potential snag loads to the conductor. The tree accepts skids for flow boosting, metering, water-oil separation, etc. A conventional choke may be fitted outboard (i.e., downstream) from the utility insert profile.

The foregoing and other objects and advantages of the present invention will be apparent to those skilled in the art, in view of the following detailed description of the present invention, taken in conjunction with the appended claims and the accompanying drawings.

BRIEF DESCRIPTION OF THE DRAWINGS

So that the manner in which the features and advantages of the present invention, which will become apparent, are attained and can be understood in more detail, more particular description of the invention briefly summarized above may be had by reference to the embodiments thereof that are illustrated in the appended drawings which form a part of this specification. It is to be noted, however, that the drawings illustrate only some embodiments of the invention and therefore are not to be considered limiting of its scope as the invention may admit to other equally effective embodiments.

DETAILED DESCRIPTION OF THE INVENTION

Figure 1:
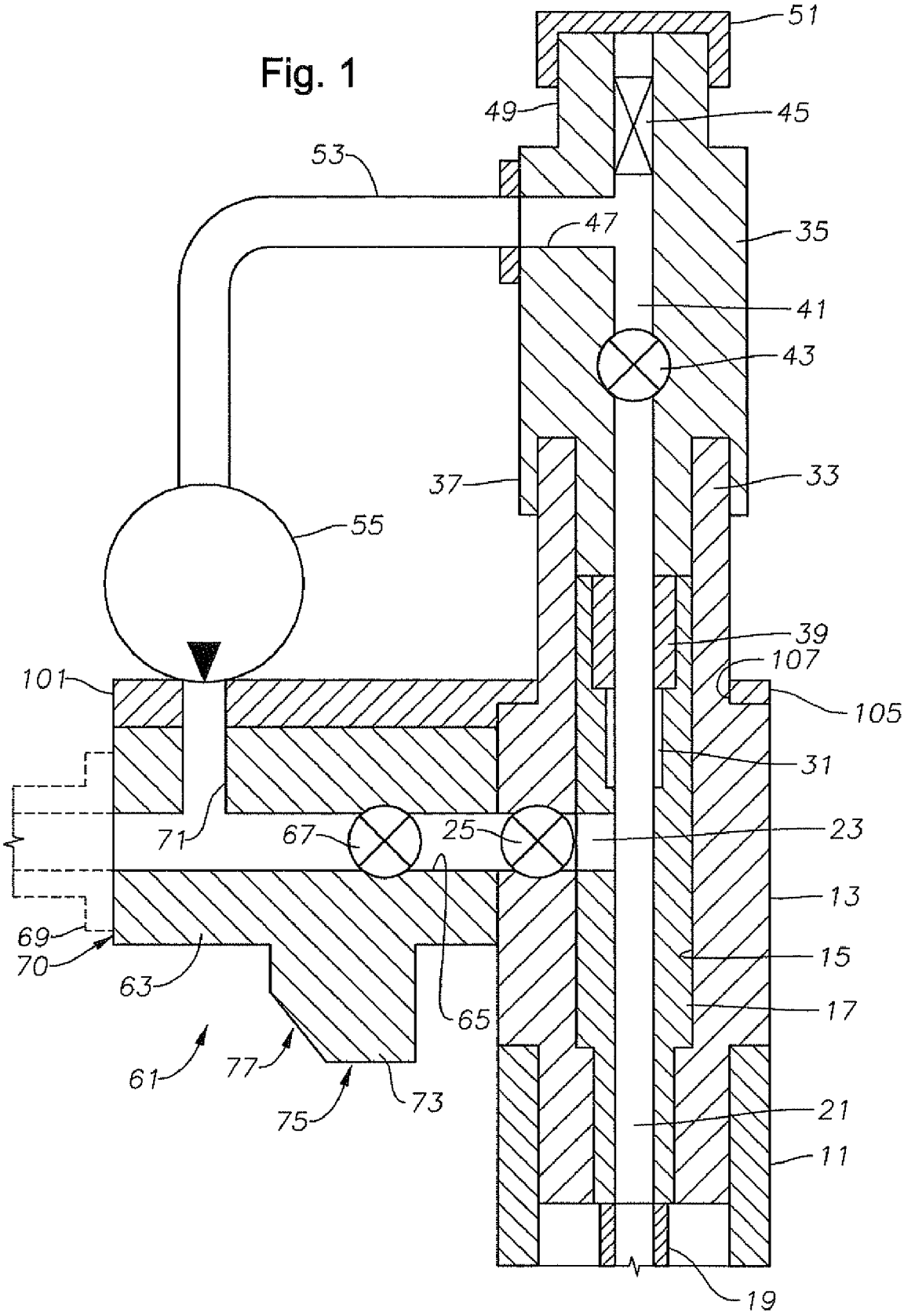
FIG. 1 is a sectional side view of one embodiment of utility skid tree system constructed in accordance with the invention.

Referring to FIGS. 1-4, embodiments of a system, method and apparatus for a utility skid tree support system for subsea wellheads are shown. A wellhead housing 11 is located at the upper end of a subsea well. Wellhead housing 11 is a large tubular member mounted to a conductor pipe that extends to a first depth in the well.

A subsea Christmas or production tree 13, such as a horizontal or spool tree, is secured to the upper end of wellhead housing 11 by a conventional connector. Tree 13 has a bore 15 that contains a tubing hanger 17. Tubing hanger 17 supports a string of tubing 19 that extends into the well for the flow of production fluid. Tubing 19 registers with a production passage 21 that extends through tubing hanger 17. A lateral production port 23 extends from production passage 21 through a production master valve 25 within tree 13. The invention also is well suited for conventional or vertical tree applications such as those known to persons of ordinary skill in the art.

Production passage 21 of tubing hanger 17 has a crown plug profile 31 or profiles (e.g., where the tubing hanger has dual plugs) located above lateral production port 23. Profile 31 is adapted to receive a plug normally lowered and retrieved by a wireline. Tree 13 has a mandrel 33 on its upper end containing an external grooved profile. An adapter 35 lands on tree 13, and installation may be from a rig or other vessel including ROV utilizing buoyancy, etc. Adapter 35 has a conventional, hydraulically-actuated connector 37 for connecting to tree mandrel 33. Mechanical or hydraulic and mechanical connectors also may be used. Adapter 35 has a seal sub 39 that extends downward into sealing engagement with production passage 21 in tubing hanger 17. Adapter 35 has a production passage 41 that registers with seal sub 39 for the flow of production fluid. An isolation valve 43 and a retrievable plug 45 are located within production bore 41. A swab valve may be used in lieu of plug 45. In vertical tree applications, the adapter seals in the tree mandrel, rather than in the tubing hanger, since the tubing hanger sits in the wellhead below the tree.

A lateral production port 47 extends from production bore 41 between valve 43 and a crown plug 45. Adapter 35 preferably has a mandrel 49 on its upper end that receives a debris cap 51 that may or may not be pressure-containing. Any third line pressure containing debris cap may be installed by ROV or other remote operation. Lateral production port 47 connects to an intake conduit 53. A flow interface device 55 improves the well productivity. For example, a subsea pressure intensifier or oil separator may be installed via a vessel with wireline from surface of ROV with buoyancy modules. The subsea pressure intensifier is connected to intake conduit 53, which is preferably shorter than it appears in the drawings. Alternatively, a dual barrier in the form of, e.g., two crown plugs above the production outlet 47 also may be employed.

The device 55, or an outlet conduit extending therefrom (not shown), is connected to a utility skid tree support system 61. In one embodiment, system 61 comprises a wing block 63 having an extended length, a horizontal bore 65 and a vertical bore 71 extending upward therefrom to device 55. The wing block 63 may be mounted to tree 13 as shown on a lip 66 (FIG. 2), or integrally formed with tree 13 (not shown). Horizontal bore 65 has a production wing valve 67 (FIG. 1) that is mounted adjacent to and in fluid communication with production master valve 25 and lateral production port 23. Horizontal bore 65 may be interconnected to a choke body 69, which also may comprise a T-conduit or still other equipment. In vertical tree applications, the upper and lower master valves are in the vertical orientation.

As best shown in FIG. 1, production wing valve 67 may be located horizontally closer to production master valve 25 than to an end face 70 of wing block 63. In contrast, vertical bore 71 is located horizontally closer to end face 70 than production master valve 25. In a similar non-symmetrical sense, horizontal bore 65 is located closer to left side face 72 (FIGS. 2 and 3) of wing block 63 than right side face 74 thereof.

Figure 2:
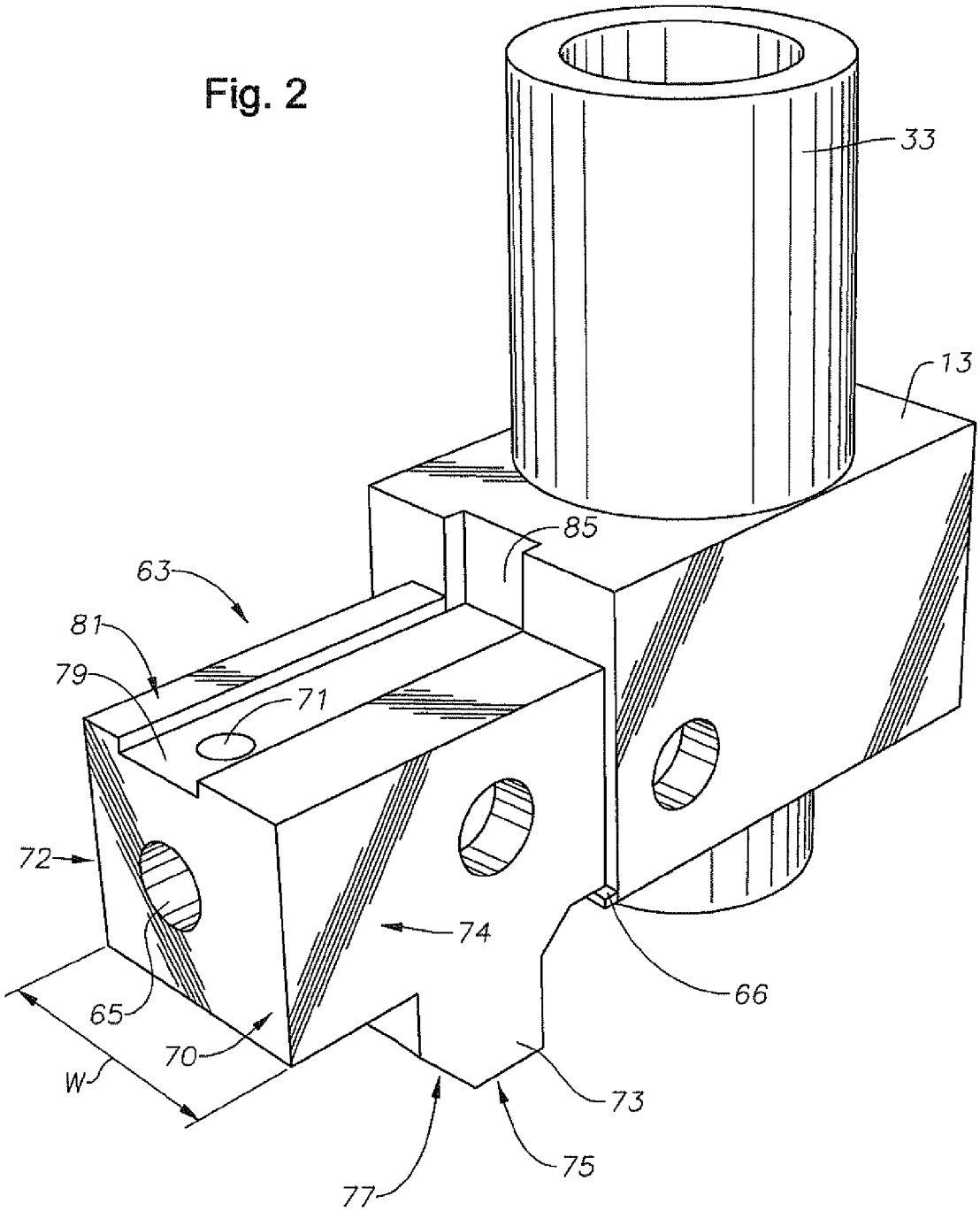
FIG. 2 is an isometric view of one embodiment of a subassembly of the system of FIG. 1 and is constructed in accordance with the invention.
Figure 3:
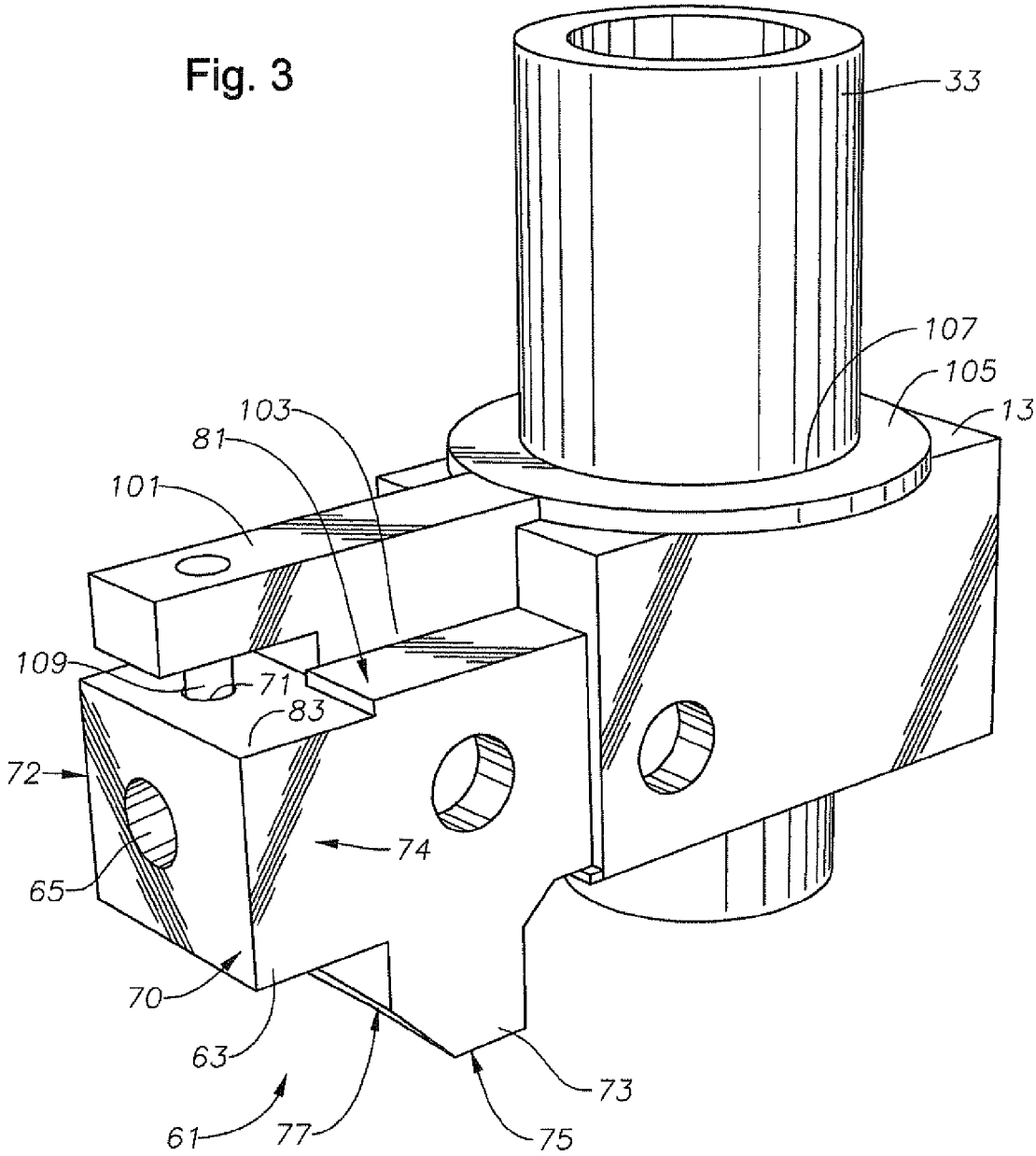
FIG. 3 is an isometric view of another embodiment of a subassembly of the system of FIG. 1 and is constructed in accordance with the invention.

In one embodiment, a block leg 73 extends downward from wing block 63 directly beneath wing valve 67. For example, the block leg 73 may extend across the entire width W of wing block 63, and be provided with a horizontal lower surface 75 and a chamfer 77. In addition, a wide groove 79 is formed on a top surface 81 of wing block 63. As shown in FIG. 2, groove 79 may extend from end face 70 to tree 13 as shown. Alternatively, groove 79 may be offset from end face 70 (FIG. 3) and intersect an orthogonal shelf 83 formed below and parallel to top surface 81. In one embodiment, groove 79 is located directly above horizontal bore 65, such that it too is closer to left side face 72 than right side face 74. This configuration segments the top surface 81 into a smaller portion (see left side of FIG. 2) and a larger portion (right side of FIG. 2). A complementary vertical groove 85 is formed on the side of tree 13 and aligns with groove 79. Essentially, this interface provides a universal input port that allows the insertion of additional equipment at any point during the tree systems' life.

Referring again to FIGS. 1 and 3, the support system 61 further comprises a utility skid 101 having an elongated body with a rectangular foot 103 extending downward therefrom. Foot 103 is closely received by groove 79 (FIG. 2) and groove 85 in the tree master valve block 13 for mating engagement therewith. In one embodiment, a flat ring 105 protrudes horizontally from a tree side end of skid 101. Ring 105 has an opening 107 for receiving mandrel 33 as shown, which helps to locate and align skid 101 with respect to the tree 13 and support system 61. Skid 101 may be provided with a tab 109 (which may be optional) that extends vertically downward from an opposite end thereof with respect to ring 107. Tab 109 engages vertical bore 71 in wing block 63 to complete a mating alignment between skid 101 and wing block 63. Tab 109 also seals in vertical bore 71 for pressure containment. Dual seals also may be used. Other embodiments include, for example, a sleeve that fits over the mandrel and offers good resistance to bending. The sleeve is short enough to accommodate the swallow of the connector 37.

In one operational embodiment, the well may be initially producing with sufficient pressure to flow well fluid to a surface processing facility. In such case, adapter 35, device 55 and its conduit 53 would not be located subsea. An internal tree cap would be located at the upper end of tree 13 for sealing bore 15. A plug would be located in profile 31. The fluid would flow out through valves 25 and 67, through the choke in choke body 69, and into a production flow line. In normal operations, a locking sealing cap would be in place. The sealing cap would interface with the geometry of the tree and wing block. Alternatively, a blind locking sealing cap may be run in the base. Should intervention or additional functionality be required, the blind cap may be replaced by the utility skid.

If the pressure of the well depletes sufficiently so as to require a booster pump, the operator could then connect a riser or other intervention equipment (not shown) to tree mandrel 33. The operator closes valves 25, 67, which along with production port 23, make up a main flow path. The operator removes the internal tree cap through the riser while leaving the crown plug within crown profile 31. The operator may close valves and any other action required to make the well safe to allow removal of the internal tree cap. The operator then lowers adapter 35, device 55 and its conduit 53 as a unit. Seal sub 39 stabs sealingly into tubing hanger bore 21, or into the tree mandrel in the vertical tree case. Connector 37 connects adapter 35 in place, and device 55 is connected to wing block 63. The conduit 71 may be integral with, or locked to the wing block 63 with some form of locking mechanism. A downward force due to the weight of device 55 passes through adapter 35 and tree 13 into wellhead housing 11. This interface can be extended to receive a multitude of subsea processing or boosting equipment, such as separators, pumps, compressors, etc.

The operator reconnects the riser at this time to adapter mandrel 49. With a wireline tool, the operator removes plug 45 (or, e.g., dual barriers) from its position above lateral production port 47. The operator opens valve 43 and removes the crown plug from profile 31 and reinstalls plug 45 above production port 47. The riser is removed and debris cap 51 is installed on adapter 35. Once the intervention tooling is removed, a debris cap can be installed on mandrel 49. The debris cap may or may not be pressure containing.

In a horizontal tree case, operations are undertaken to remove the crown plug or plugs from profile 31, and install a plug or plugs in profile 45. Once these operations are complete, a debris cap can be installed on the adapter mandrel 49. These operations can be carried out using intervention tooling that may or may not include a riser system.

Device 55 also may operate in combination with a downhole electrical submersible pump suspended on tubing. If the assembly is to be used as an injection well, device 55 would operate in the reverse direction and fluid would flow from choke body 69, if applicable, to device 55, which pumps fluid down production passage 21. If device 55 is to be utilized from the beginning, it could be lowered and installed initially along with tree 13. For removing device 55 to repair or replace it, the operator attaches intervention tooling, removes plug 45 and sets a plug into crown plug profile 31.

Once the plug is set in profile 31, the operator disengages connector device 55 and connector 37 and retrieves the assembly to the surface. The operator then lowers the assembly with a new or repaired device 55 and repeats the process. In addition, the operator has the ability of lowering tools or instruments on wireline or coiled tubing into tubing 19 by removing debris cap 51 and connecting intervention tooling to mandrel 49. Plug 45 is then removed through the riser, providing access for wireline tools.

Figure 4A:
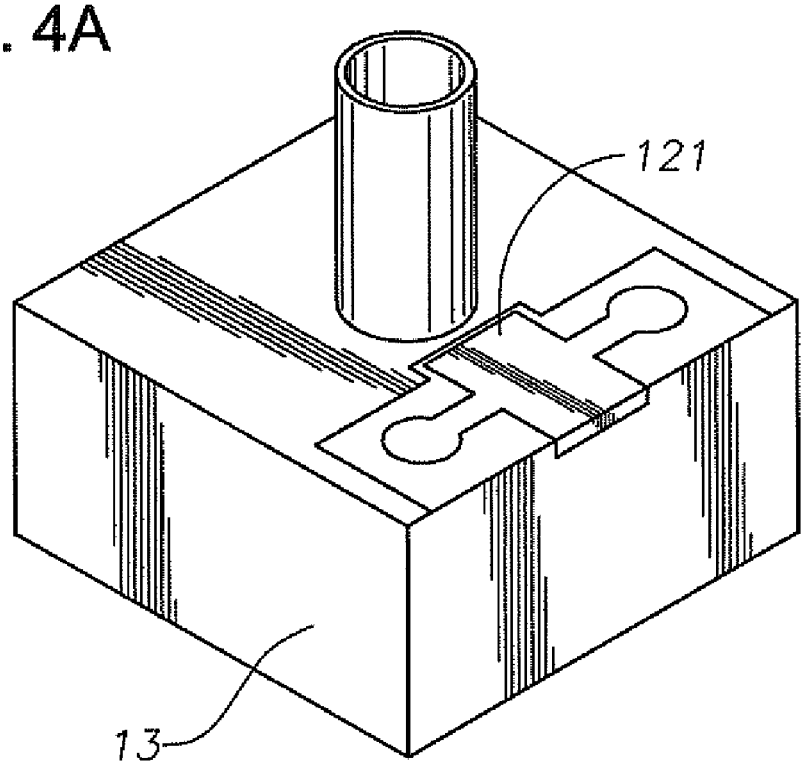
FIG. 4 is an isometric view of still another embodiment of a subassembly of the system of FIG. 1 and is constructed in accordance with the invention.
Figure 4B:
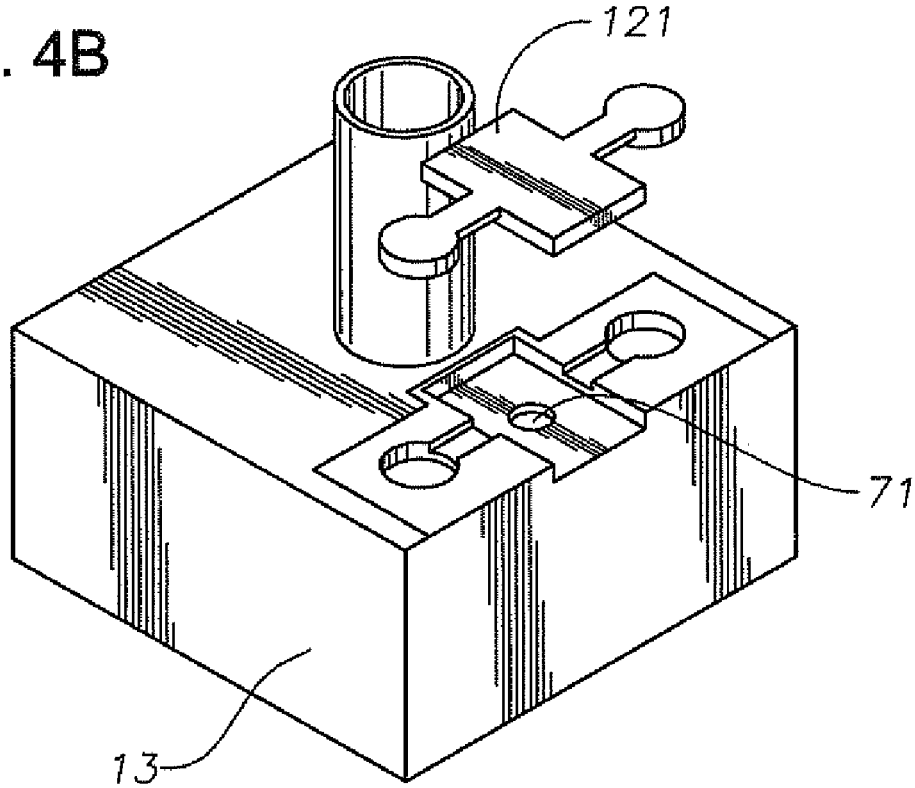
Figure 4C:
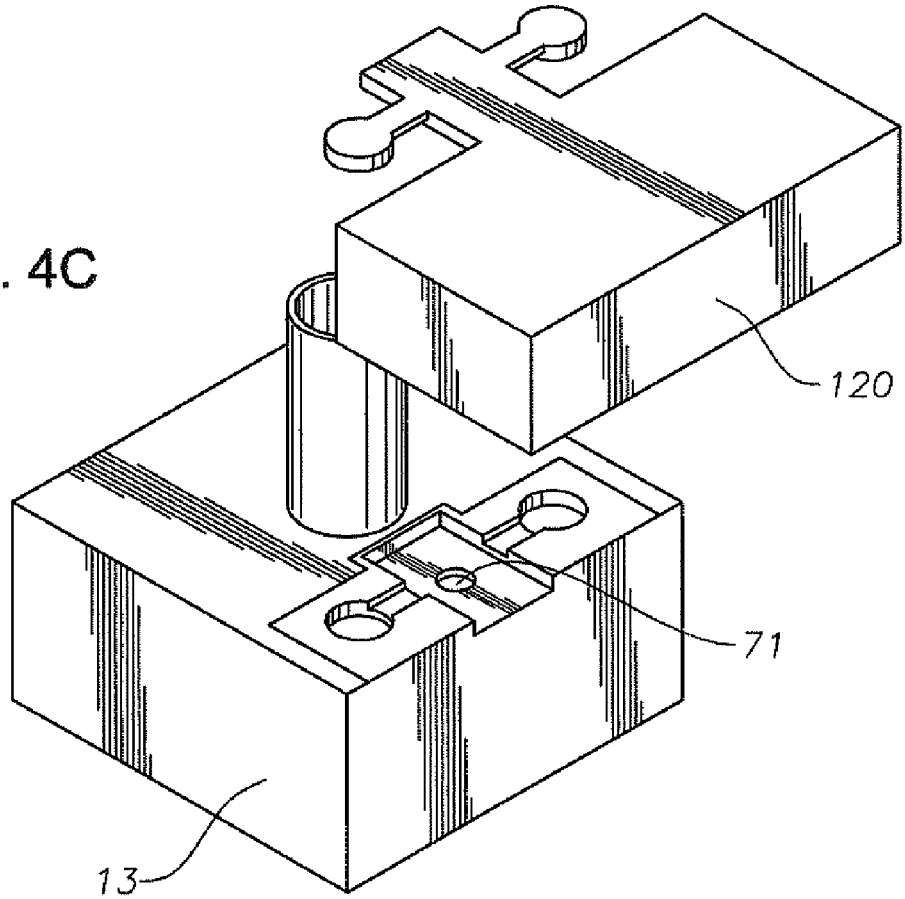
Figure 4D:
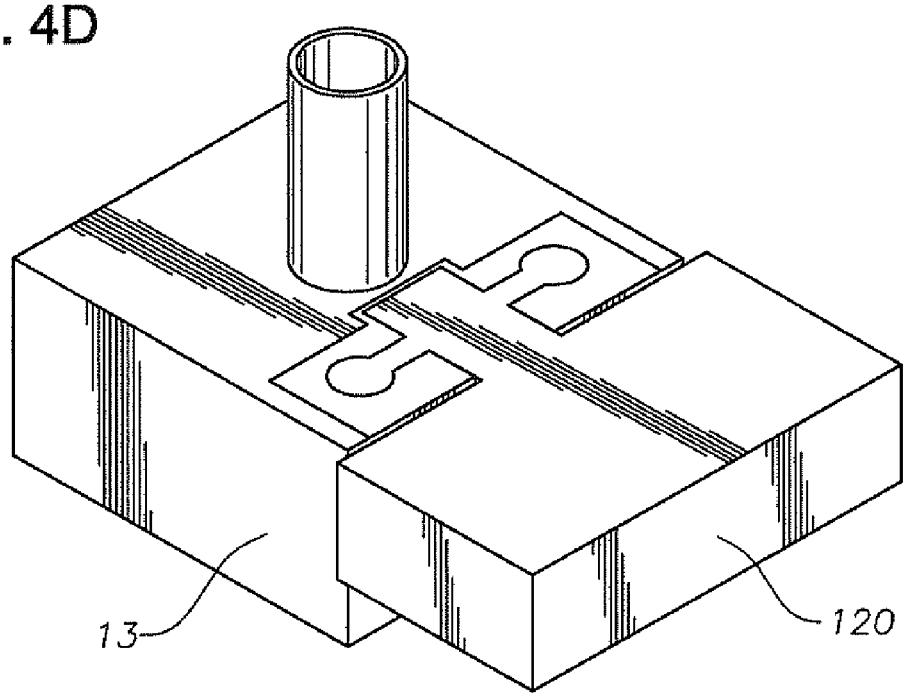

Referring now to FIGS. 4A-4D, in another embodiment of the invention the tree 13 (shown schematically) also may be run in and installed without the utility skid. In this embodiment, the profile of the vertical bore 71 is sealed off with a seal cap or plug 121. In FIG. 4A, the tree is run with the plug 121 installed in the mounting profile of bore 71, and then removed (FIG. 4B) for the installation of utility skid 120 (FIG. 4C). When the utility skid 120 is required, the plug 121 is removed and the utility skid 120 is run, locked and seals onto the wing block to complete the installation (FIG. 4D).

The invention has significant advantages. Supporting utility skids with a wing block for the tree utilizes the extensive strength of the tree mandrel to avoid the need for specially constructed supporting frames. Equipment such as pump assemblies can be readily installed and retrieved for maintenance. The assembly allows access to the tree tubing and tubing annulus for workover operations. The system reacts and transfers installation loads and potential snag loads to the conductor. The tree accepts skids for flow boosting, metering, water-oil separation, etc. It also allows access to the production tree outboard of the production wing valve completely independent of the production choke valve.

While the invention has been shown or described in only some of its forms, it should be apparent to those skilled in the art that it is not so limited, but is susceptible to various changes without departing from the scope of the invention. For example, On the opposite side of the production wing outlet is the annulus wing outlet. The annulus wing outlet may have the same feature on the annulus side, to facilitate plugging in to access the annulus for gas lift and/or other applications.

What is claimed is:

1. A subsea tree, comprising:

a tree body having a bore, a lateral production port extending from the bore, and a mandrel;

to utility skid tree support system having a wing block and a utility skid;

the wing block is mounted to the tree body below the mandrel and has a horizontal bore aligned with the lateral production port, a vertical bore extending from the horizontal bore in the wing block and through the utility skid, and a top surface with a groove; and the utility skid having an aligning member for engaging the mandrel to locate and align the utility skid with respect to the tree body comprising a sleeve that horizontally from the utility skid and circumscribes the mandrel, and a foot inserted into the groove.

2. A subsea tree according to claim 1, wherein the wing block is integrally formed with the tree body.

3. A subsea tree according to claim 1, wherein the wing block has a production wing valve that is located horizontally closer to the tree body than to an opposite end face of the wing block, the vertical bore is located horizontally closer to the opposite end face than to the tree body, and the horizontal bore is located closer to one side face of the wing block than an opposite side face thereof.

4. A subsea tree according to claim 1, wherein the wing block has is block leg extending downward therefrom, the block leg extending across an entire width of the wing block transverse to a direction of the horizontal bore, and the block leg having a horizontal lower surface and a chamfer on one side thereof.

5. A subsea tree according to claim 1, wherein the groove extends from an end face of the wing, block to the tree body.

* * * * *